United States Patent [19]

Leuthold

[11] Patent Number: 4,568,137

[45] Date of Patent: Feb. 4, 1986

[54] ELECTRICAL CONNECTOR HAVING AT LEAST ONE FUSE CARTRIDGE

[75] Inventor: Karl Leuthold, Zurich, Switzerland

[73] Assignee: Feller AG, Horgen, Switzerland

[21] Appl. No.: 577,698

[22] Filed: Feb. 7, 1984

[30] Foreign Application Priority Data

Feb. 9, 1983 [CH] Switzerland ..... 721/83

[51] Int. Cl.[4] ..... H01H 85/02; H01H 85/50

[52] U.S. Cl. ..... 339/147 R; 337/195; 337/213

[58] Field of Search ..... 337/194, 196, 211, 212, 337/213, 214, 217, 218, 195; 339/147 R, 147 P, 44 R, 44 M, 91 R

[56] References Cited

U.S. PATENT DOCUMENTS

| | | | |
|---|---|---|---|
| 2,870,933 | 1/1959 | Winter | 339/44 R |
| 3,192,499 | 6/1965 | West | 339/91 R |
| 3,243,550 | 3/1966 | Hollins | 337/195 |
| 3,659,252 | 4/1972 | Brown | 337/201 |
| 3,976,967 | 8/1976 | Magherini | 339/147 P |
| 4,126,368 | 11/1978 | Godfrey et al. | 339/91 R |
| 4,178,061 | 12/1979 | Ahroni | 339/147 P |
| 4,214,802 | 7/1980 | Otani et al. | 339/91 R |
| 4,453,794 | 6/1984 | Wallner et al. | 339/90 F |

*Primary Examiner*—Gil Weidenfeld
*Assistant Examiner*—Gary F. Paumen
*Attorney, Agent, or Firm*—Samuelson & Jacob

[57] ABSTRACT

An electrical connector has an arrangement for holding and connecting at least one fuse cartridge within the body of the connector, the arrangement including a fuse cartridge holder slideably received within a recess in the connector body, in a rectilinear manner, and secured in place in the connector body by a selectively disengageable latch mechanism.

6 Claims, 16 Drawing Figures

ELECTRICAL CONNECTOR HAVING AT LEAST ONE FUSE CARTRIDGE

BACKGROUND OF THE INVENTION

The invention relates to an electrical appliance connector which has a means for the accommodation of at least one fuse cartridge having an insulating tube with two electrically conductive end caps and a fusible wire disposed in the insulating tube and connecting the end caps to one another. In a known manner, the connector has a body of insulating material with at least one recess, a fuse cartridge holder releasably inserted into the recess, a bottom contact disposed in the recess to make contact with the first end cap of the fuse cartridge, and at least one side contact also disposed in the recess, while the fuse cartridge holder has an insulating part which can be grasped externally, an electrically conductive clip for holding the second end cap of the fuse cartridge, and at least one contact for the electrical connection of the clip to the side contact in the recess in the insulating base.

In known electrical connectors of this kind, the fuse cartridge holder is retained in its active position inserted into the recess in the insulating body either by means of a screw thread or by means of a so-called bayonet joint. In both cases, the fuse holder has to be rotated for insertion and for removal. The need for the rotatability of the holder limits the designer's freedom with regard to the configuration of the means for the electrical connection of the clip gripping the second end cap of the fuse cartridge to the side contact disposed fixedly in the recess in the insulated base.

The present invention, therefore, is intended for the solution of the problem of designing an electrical connector of the kind described above such that the holder will not have to be rotated in order to lock the fuse cartridge in its active position in the recess in the insulated body.

THE INVENTION

This problem is solved by the creation of an electrical connector in which the insulating portion of the holder for the fuse cartridge is slidingly guided in the recess of the insulating body, so that the holder is insertable into the recess and removable therefrom in a rectilinear manner, that the connecting contact forming a part of the holder is in the form of a sliding contact for contacting the side contact in the recess of the insulating body, and that a locking hook which can be moved into and out of the active position, and a locking edge with which the locking hook can be brought into locking engagement, are disposed one on the insulating portion of the holder and the other on the insulating base that has the recess such that, by means of the locking hook and the locking edge, the holder can be locked in its active position in the recess of the insulating body.

In the appliance connector of the invention, the holder bearing the fuse cartridge can be pushed rectilinearly into the recess in the insulated body and locked in its active position by the hooking of the catch on an edge of the body. The contact serving for the electrical connection of the clip holding the second end cap of the fuse cartridge to the stationary side contact in the recess of the insulating body is therefore simply constructed in the form of a sliding contact which resiliently engages the stationary side contact when the holder assumes its active position in the recess in the insulated body.

It is desirable that the hook be formed on a resiliently flexible tongue extending laterally from the insulating part of the holder towards the outer end of the holder, and that it have a free end portion which can be grasped from without, and which makes it possible by flexing the tongue to bring the hook out of engagement with the edge of the insulating body, and then to extract the holder from the recess in the insulating body.

Advantageously, a variety of holders are provided for fuse cartridges of different external dimensions, and they are constructed such that these holders with the fuse cartridges mounted on them can be selectively inserted into the recess in the insulating body. Thus it is possible to use the appliance with different European and American fuse cartridges.

Other features and details of the invention will be found in the description that follows, in conjunction with the appended drawings, relating to preferred embodiments thereof.

DESCRIPTION OF PREFERRED EMBODIMENTS

Figure 1:
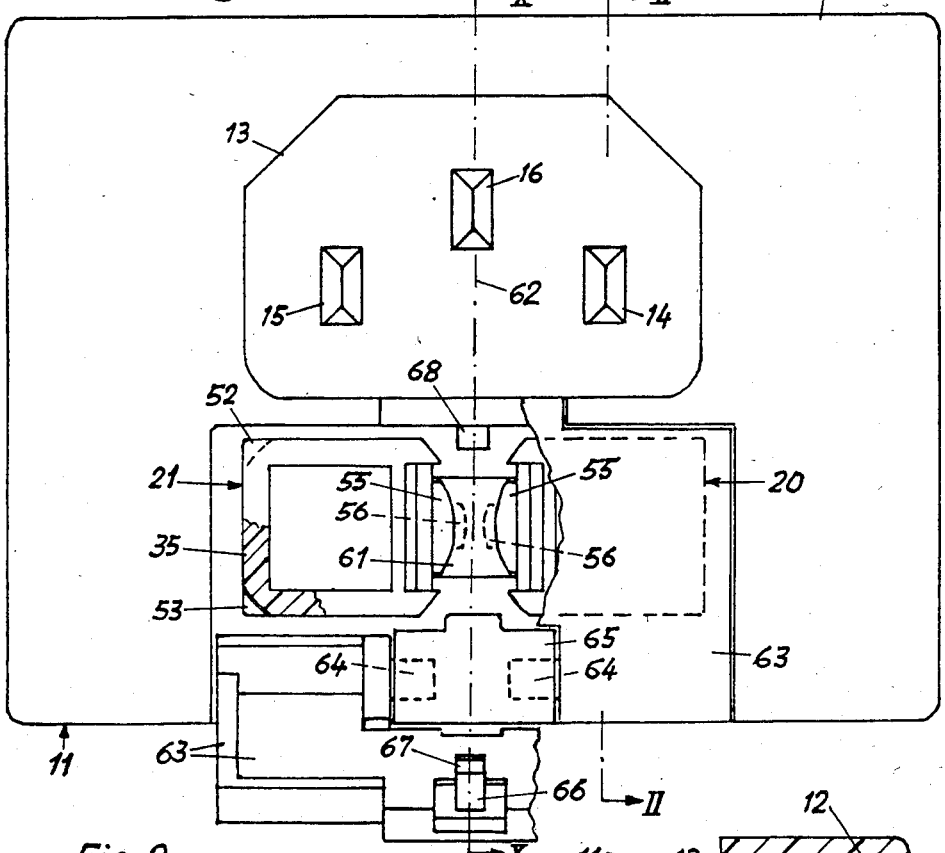
FIG. 1 is a front elevational view of an electrical connector having devices for the accommodation of two fuse cartridges; a hinged cover, which serves to cover the fuse cartridge holder, is represented partially in the closed state and partially in the open state.

The illustrated connector has a body 11 made of an insulating material and composed of two parts 11*a* and 11*b*, as seen in FIGS. 2, 3, 7, 8 and 20. The insulating body 11 is provided with a flange 12 and is intended for installation in an approximately square opening in a wall of the casing of an electrical appliance (not shown). In a recess 13 opening on the front of the appliance connector (FIGS. 1, 2 and 10) there are three parallel plug pins 14, 15 and 16 which are anchored in the bottom 17 of the recess 13. The plug pins 14 to 16 are intended for engagement with corresponding sockets in a plug-in terminal (not shown) of a power cord, the terminal being inserted into the recess 13 of the insulating body 11.

Figure 2:
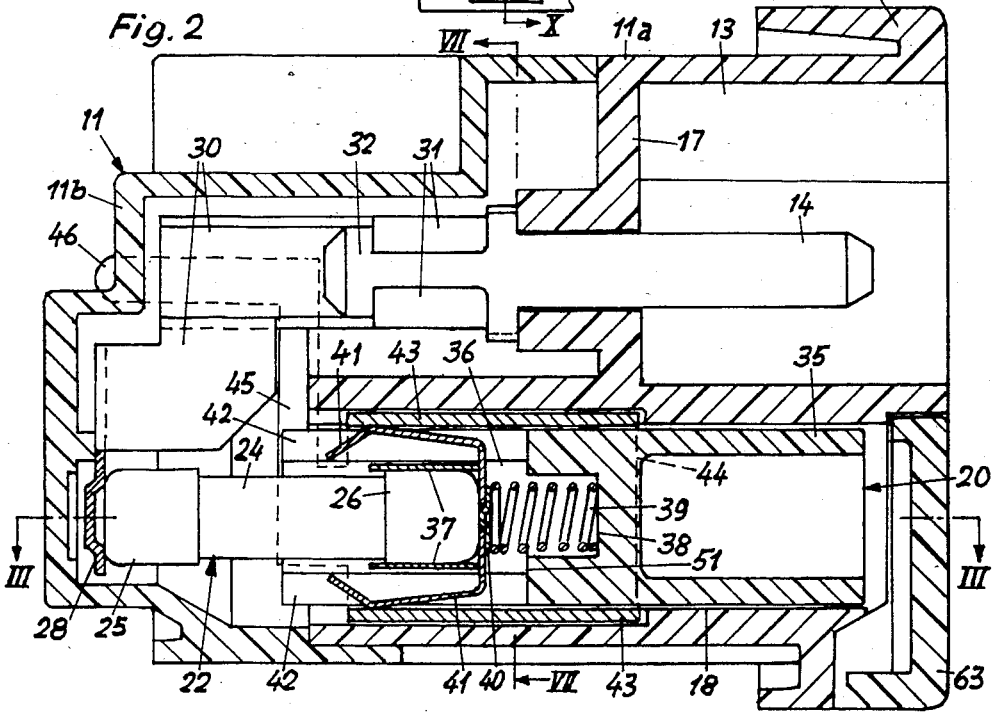
FIG. 2 is a longitudinal cross section taken along the line II—II of FIG. 1.
Figure 7:
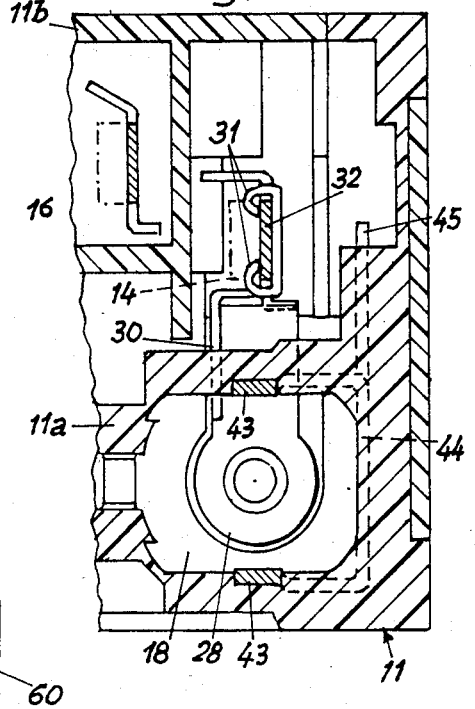
FIG. 7 is a fragmentary view of the appliance connector, without a fuse cartridge holder, in a cross section taken along line VII—VII of FIG. 2.

Furthermore, cavities or recesses 18 and 19 are provided in the insulating body 11 (FIGS. 2, 3, 7 and 8) for the accommodation of two holders 20 and 21 containing electrical fuse cartridges 22 and 23. In a known manner, each of the fuse cartridges 22 and 23 consists of an insulating tube 24 having two electrically conductive end caps 25 and 26 and a fusible wire disposed in the insulating tube 24 and connecting the two end caps 25 and 26 to one another electrically. In each of the cavities 18 and 19 there is a bottom contact 28 and 29, respectively, intended to make contact with the one end cap 25 of the fuse cartridge 22 and 23, respectively. In FIGS. 2 and 7 it can be seen that the bottom contact 28 is a part of a piece of sheet metal 30 having multiple bends, which is fastened by crimps 31 to a terminal lug 32 of the plug pin 24. The other bottom contact 29 is fastened to the plug pin 15 in the same manner.

The two holders 20 and 21 for the fuse cartridges 22 and 23 are of identical construction. Each holder has an insulating portion 35 whose external shape is substantially rectangular, as best seen in FIGS. 4, 5 and 6. In the insulating portion 35 there is a cavity 36 (FIGS. 2, 3 and 6) which is open at the inside end of the insulating portion 35. A clip 37 (FIGS. 2, 3 and 6) made of electrically conductive and resilient material is disposed in the cavity 36 for the purpose of holding the end cap 26 of the fuse cartridge 22 or 23. The clip 37 is displaceable within the cavity 36 longitudinally with respect to the insulating portion 35 and the fuse cartridge 22 or 23. Between the clips 37 and a surface 38 of the insulating portion 35 facing the clip 37, there is inserted a helical compression spring 39 which urges the clip 37 toward the inside end of the insulating portion 35, simultaneously biasing the first end cap 25 of the fuse cartridge 22 or 23 against the associated bottom contact 28 or 29 when the insulating portion 35 is in its active position in the insulating body 11.

The clip 37 is combined together with a substantially U-shaped spring 40 (FIGS. 2 and 6) of electrically conductive material to form a single unit. The two legs 41 of the spring 40 extend through two oppositely situated longitudinal slots 42 in the insulating part 36 and project laterally beyond the insulating part 36, as best seen in FIGS. 4 and 6. The spring legs 41 serve as sliding contacts which are intended for cooperation with a pair of stationary side contacts 43 (FIGS. 2, 7 and 8) in the recess 18 or 19 of the insulating body 11. When the holder 20 or 21 assumes its active position in the recess 18 or 19 of the insulating body, the legs 42 serving as sliding contacts are biased resiliently against the stationary side contacts 43 in order to connect the latter electrically to the clip 37. The side contacts 43, forming a pair, are connected together by a yoke 44 (FIGS. 2, 3, 7 and 8) having a projection 45 with a terminal lug 46 (FIG. 2) for an electrical conductor.

The clip 37 has a tongue-like projection 47 (FIGS. 3, 5 and 6) which extends through a lateral opening 48 (FIG. 3) into a longitudinal slot 49 in the insulating portion 35. The projection 47 serves as a snap catch, which is intended to abut against a margin 50 of the opening 45 and prevent the component 37 and 40 from being driven by the compression spring 39 out of the cavity 36 in the insulating portion 35 if no fuse cartridge is inserted into the clips 37 or the holder 20 or 21 has been removed from the insulating body 11. The projection 47 and the opening 48 are of such dimensions and adapted to one another such that the projection 47 can easily snap through the opening 48 if the component 37, 40, is pushed sufficiently deeply into the cavity 36 of the insulating portion 35 against the thrust of the compression spring 39. This permits a simple assembly of the parts forming the holder 20 or 21: first the compression spring 39 is placed in the cavity 36, and then the component 47, 40, is also introduced into the orifice of the cavity 36, taking care to see that the legs 41 of the spring 40 enter the longitudinal slots 42 of the insulating portion 35 and the projection 47 is facing the longitudinal slot 49. Then, by means of a rod-like plunger the component, 37/40 is pushed against the thrust of the compression spring 39 deeper into the cavity 36, the projection 47 being first forced inwardly against its bias until the free end of the projection 47 has moved past the rim 50 of the opening 48, and then the projection automatically snaps through the opening 48 into the longitudinal slot 49 and assumes its active position. To safeguard against excessive compression of the coil spring 39 when the connector is assembled and when the fuse cartridge 23 is inserted into the clip 37, a stop 51 is formed in the cavity 36 (FIGS. 2 and 3), which limits the depth to which the component 37, 40, can be inserted.

The insulating portion 35 of each holder 20 and 21 is held slidingly in the associated recess 18 and 19, respectively, so that the holders 20 and 21 can be inserted in a straight line, parallel to the plug pins 14 to 16, into the recesses 18 and 19, respectively, and withdrawn from them in the same manner. FIGS. 6 and 7 show that the insulating portion 35 of the holders 20 and 21 and the recess 18 (and 19) of the insulating body 11 have mating outer and inner circumferential surfaces which prevent the holder from turning in the recess, and also permit the holder to be inserted into the recess only in one predetermined position. To limit the insertion movement of the holders 20 and 21, two small corner tabs 52 (FIGS. 1, 5 and 6) are formed at the outer end of the insulating portion 35, and with each of them there is associated an abutment 53 (FIG. 1) close to the orifice of the recesses 18 and 19 of the insulating body 11.

Figure 3:
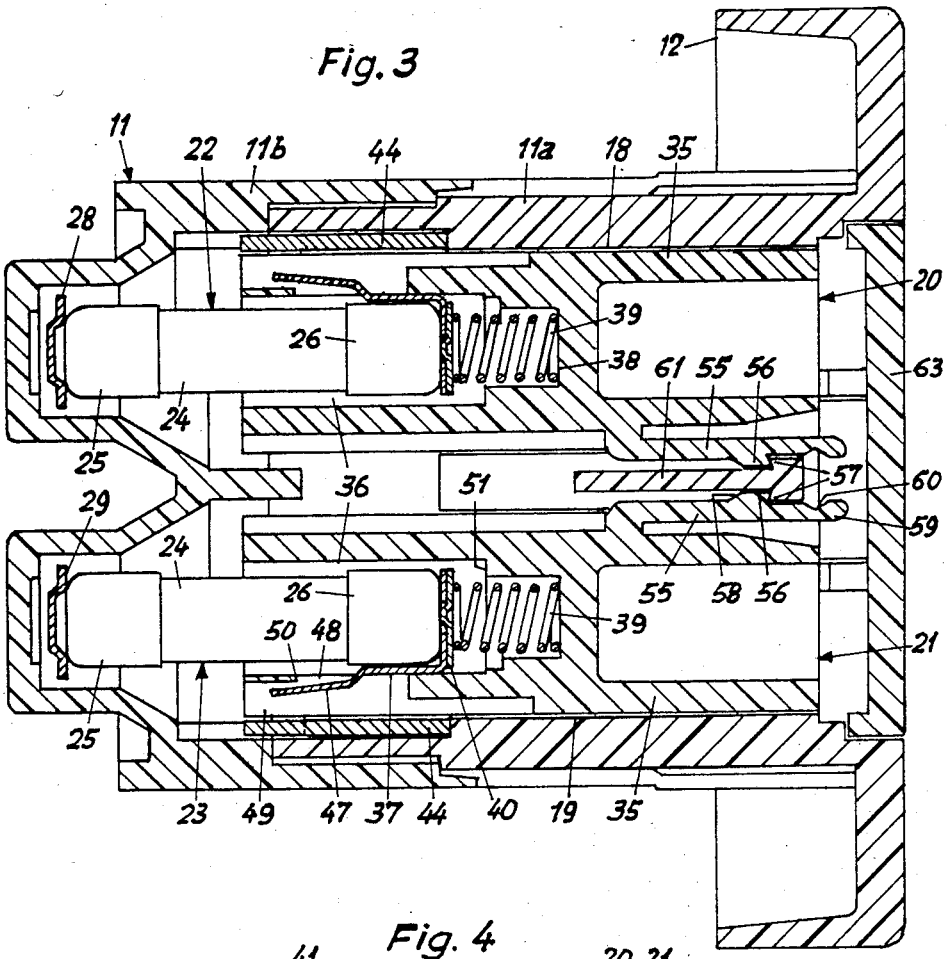
FIG. 3 is a longitudinal cross section taken along line III—III of FIG. 2.
Figure 4:
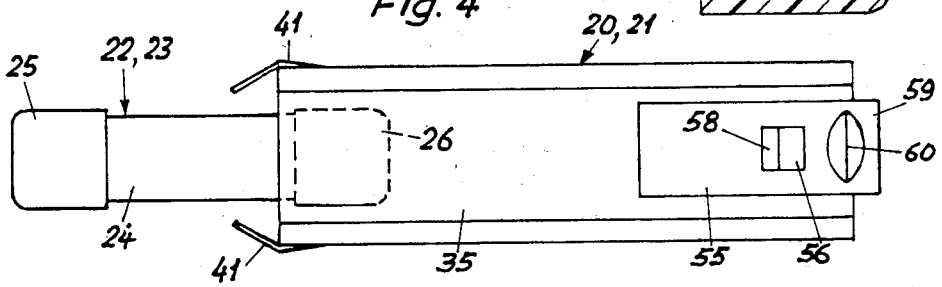
FIG. 4 is a side view of a single holder with a fuse cartridge disposed thereon, which is of the dimensions commonly used in Europe.
Figure 5:
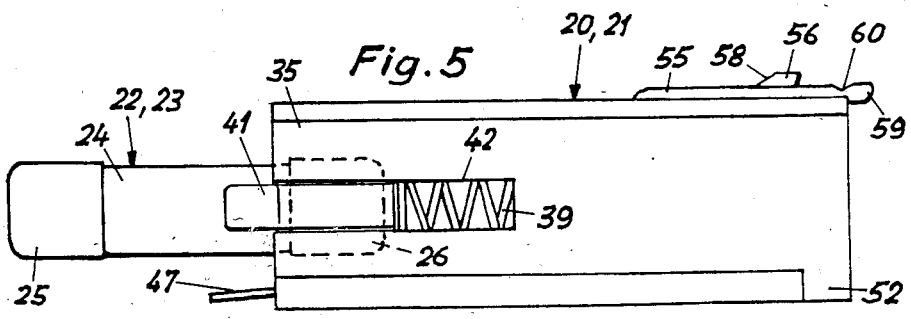
FIG. 5 shows the same holder as in FIG. 4 in a different side view.
Figure 6:
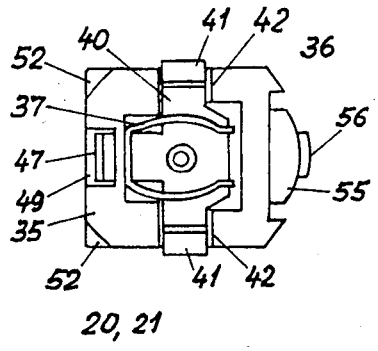
FIG. 6 shows the same holder (without fuse cartridge) as seen from the left inside end in FIG. 4.

A resilient tongue 55 projects from one lateral outside surface of the insulating portion 35 of each holder 20 and 21 and extends approximately parallel, to the direction of movement of the holders 20 and 21 toward the right end of the insulating portion 35 as represented in FIGS. 3 to 5. The tongue 55 has a catch 56 which is provided for the purpose of catching on an associated edge 57 of the insulating body 11 for the purpose of locking the holders 20 and 21 in their active position in the recesses 18 and 19, respectively. The tongue 55 is resiliently flexible, so that the catch 56 can be moved into and out of the engaging position. On the hook 56 there is provided a ramp surface 58 which brings it about that, when the holders 20 or 21 are inserted into their associated recess 18 or 19, the tongue 55 will be flexed resiliently toward the insulating portion 35, so that the catch 56 can be moved past the edge 57. When the holders 20 or 21 are inserted sufficiently deeply into their recesses 18 or 19, the catch 56, due to the bias of the tongue 55, will automatically engage the edge 57, thereby locking the holders 20 or 21 in their recesses 18 and 19, respectively. The free end portion 59 of the tongue 55 extends slightly beyond the outer end of the insulating portion 35 and thus enables the tongue 55 to be flexed with a fingertip toward the insulating portion 35, thus bringing the catch 56 out of engagement with the edge 57, so that the holders 20 or 21 can be withdrawn from the insulating body 11. On the end portion 59 a transverse notch 60 is provided, into which a fingernail can be inserted in order to withdraw the holder 20 or 21 out of the insulating body 11 after the catch 56 has been released.

It can be seen in FIGS. 1 and 3 that, when the two holders 20 and 21 are in the active position, the tongues 55 with the catches 56 are facing one another. Accordingly, the edges 57 associated with the catches 56 are present on either side of a partition 61 situated between the recesses 18 nd 19, as best seen in FIG. 3. The whole appliance connector is constructed symmetrically with respect to a plane 62 (FIG. 1) situated between the two recesses 18 and 19 of the insulating body 11 and containing the longitudinal central axis of the middle plug pin 16, the latter being provided for the connection of a grounding conductor.

Figure 10:
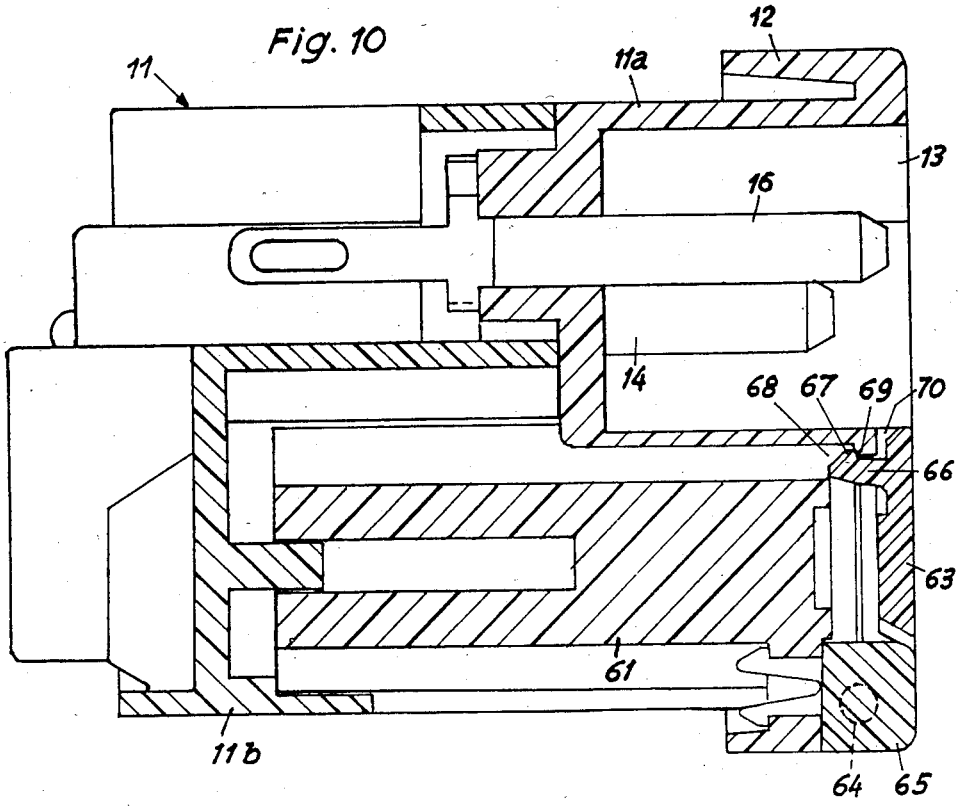
FIG. 10 is a longitudinal cross section similar to FIG. 2, taken along line X—X of FIG. 1.
Figure 11:
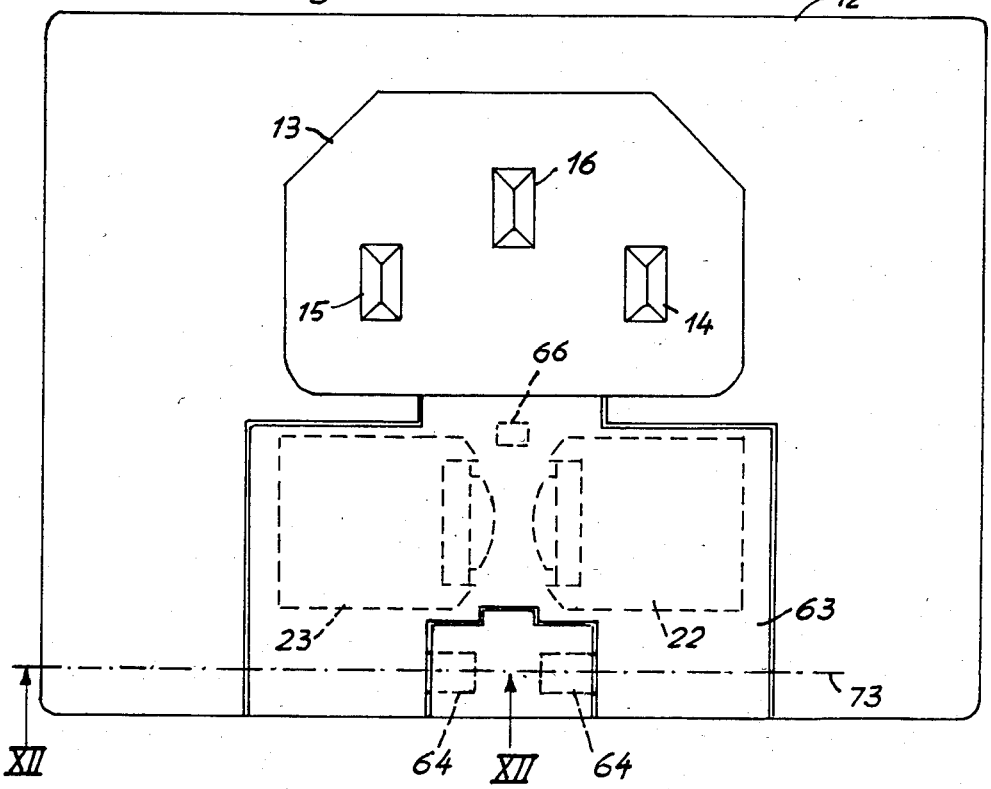
FIG. 11 is a simplified representation, similar to FIG. 1, of the connector with the cover closed.

The orifices of the two recesses 18 and 19 of the insulating body 11 and the outer ends of the insulating portions 35 of the two holders 20 and 21 can be closed by a cover 63 (FIGS. 1, 2, 3 and 8) which is hinged to the insulating body 11. In accordance with FIG. 1, in which the cover 63 is represented in the partly closed position, the cover 63 has two hinge pins 64 which are engaged in associated pivot holes in a hinge member 65, which can also be seen in FIG. 10. At a point opposite the hinge member 65 there is provided on the inside of the cover 61 a small stud 66 whose free end portion has a projection 67, as can be seen in FIG. 10. When the cover 63 is closed, the stud 66 enters into an associated opening 68 (FIGS. 1 and 10) in the insulating body 11, the projection 67 automatically coming into locking engagement with an edge 69 adjacent the opening 68, as best shown in FIG. 10, thus securing the cover 63 in the closed position. When the cover 63 is closed, a gap 70 opening towards the recess 13 is left adjacent the stud 66, into which a small screwdriver, for example, can be introduced in order to open the cover. By overcoming the holding force produced by projection 67 and the edge 69, by means of the screwdriver for example, the projection 67 can be disengaged from the edge 67, and then the cover 63 can easily be opened, permitting the holders 20 and 21 to be removed and reinserted together with the fuse cartridges 22 and 23 mounted thereon.

Figure 9:
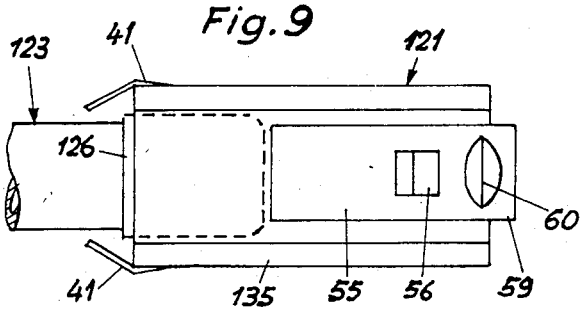
FIG. 9 is a side view similar to FIG. 4 of a single holder with a fuse cartridge disposed thereon, with the dimensions commonly used in the U.S.A. and Canada.
Figure 8:
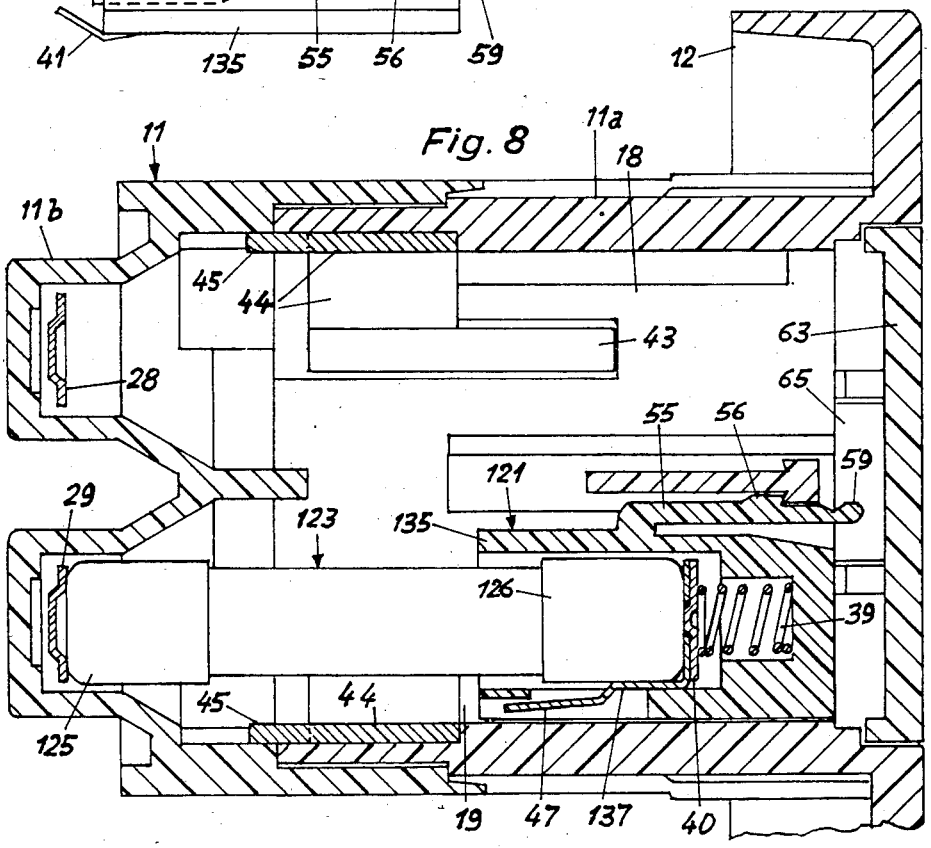
FIG. 8 is a longitudinal cross-sectional view of the same connector, in which one of the fuse cartridge holders has been removed and the second has been replaced by another holder having mounted on it a fuse cartridge of the dimensions commonly used in the U.S.A. and Canada.

The holders 20 and 21 described and represented are each intended for holding a fuse cartridge 22 and 23, respectively, of the dimensions commonly used in European countries, namely fuse cartridges of an overall length of 20.0 mm and an end cap outside diameter of 5.0 mm. In the U.S.A. and in Canada, however, fuse cartridges of larger dimensions are used, namely with an end cap outside diameter of 6.3 mm and an overall length of 31.8 mm. Now, to enable fuse cartridges of these larger dimensions to be used in the recesses 18 and 19 of the insulating body 11, other holders 121 (FIGS. 8 and 9) are additionally provided, which can be inserted into the recesses 18 and 19 instead of the previously described holders 20 and 21. In accordance with FIGS. 8 and 9, the holder 121 intended for the larger fuse cartridge 123, has an insulating portion 135 which is shorter, on the basis of the greater overall length of the fuse cartridge 123 than the insulating portion 35 of the holders 20 or 21, but otherwise is made in precisely the same manner as the insulating portion 35. The clips 137 of holder 121 serving for holding an end cap 126 of the fuse cartridge 123 has a slightly greater width than the clip 37 of holder 20 or 21, corresponding to the greater outside diameter of the end caps 125 and 126 of the fuse cartridge 123. All other features of the holder 121 are the same as those of holders 20 and 21. When the holder 121 assumes its active position in the recess 18 or 19 of the insulating body 11, the legs 41 of the spring 40, which is combined in one unit with the clip 137, are biased into engagement with the stationary side contacts 43 in the insulating body 11 in order to connect the clip 137 electrically to the side contacts 43. The helical compression spring 39 inserted in the insulating portion 135 again assures the necessary contact pressure between the end cap 125 of the fuse cartridge 123 and the bottom contacts 28 and 29, respectively, in the recesses 18 and 19 of the insulating body 11.

From the foregoing it is apparent that it is possible to insert into the recesses 18 and 19 of one and the same insulating body 11 either the holders 20 and 21 with the fuse cartridges 22 and 23 of the dimensions common in the European countries, or the holders 121 with the fuse cartridges 123 of the dimensions common in the U.S.A. and in Canada. Therefore, electrical appliances which are provided with the plug described and represented are usable both on the European and the American market. All that is needed is to insert into the recesses 18 and 19 of the insulating body 11 of the plug either the holders 20 and 21 with fuse cartridges 22 and 23, or the holders 121 with fuse cartridges 123.

Any holders, 20, 21 or 121, can be inserted into the recess 18 or 19 of the insulating body 11 by opening the cover 63 and simply inserting the insulating portion 35 or 135, as the case may be, in straight-line fashion; just before the corner tab 52 of the insulating portion 35 or 135 engages the stops 53 (FIG. 1) in the insulating body 11, the locking catch 5 of tongue 55 snaps over the edge 57. After the insulating portion 35 or 135 is released, therefore, the holder 20, 21 or 121 is secured in its active position by the locking engagement of the catch 56 with the edge 57. To remove the holder 20, 21 or 121, first the free end portion 59 of the tongue 55 is pressed with a finger or screwdriver toward the insulating portion 35 or 135 to bring the catch 56 on tongue 55 out of engagement with the edge 57. As soon as this is done, the insulating portion 35 or 135 is forced by the helical compression spring 39 partially out of the recess 18 or 19 of the insulating body 11, and then the end portion 59 of tongue 55 can easily be grasped by two fingers. If at the same time a fingernail is inserted into the notch 60 of the end portion 59, the holder 20, 21 or 121 can then be pulled by the tongue 55 all the way out of the recess 18 or 19 of the insulating body 11. The fuse cartridge 22, 23 or 123 can easily be replaced on the removed holder 20, 21 or 121.

For certain applications of the described appliance connector, it will suffice to provide the connector with only one fuse cartridge 22 or 23 or 123. In this case it is desirable to close the mouth of one of the recesses 18 and 19 in the insulating body 11 permanently, and to replace the missing fuse cartridge with an electrically conductive connection between the component 43, 44, 45, present in this recess and the contact terminal of the associated plug pin 14 or 15. Instead of this, however, it is also possible to insert a plug into one of the recesses 18 and 19 which will no longer be removable, and which has means for producing an electrical connection between the bottom contact 28 and 29 and the side contacts 43 in the corresponding recess 18 or 19.

In the foregoing description, the invention has been explained on the basis of the example of an appliance connector having two fuse cartridges or, in another case, only one fuse cartridge. The connector in accordance with the invention, does not have to have plug pins in every case. In a variant embodiment which is not shown, the insulating body can be constructed, for example, such that it has only one or two recesses 18 and 19 for the accommodation each of a holder 2, 21 or 121 for a fuse cartridge 22, 23 or 123.

Referring now to FIGS. 11 to 16, the hinging of the cover on the insulating body 11 will be described in detail, using the same reference numbers as in FIGS. 1 to 10 whenever identical parts or features of design are involved. As already mentioned, the cover 63 has two hinge pins 64 (FIGS. 11, 12 and 15) which are engaged in pivot sockets in a hinge member 65 disposed on the insulating body 11 of the appliance plug. The two hinge pins 64 each extend from a tab 71 (FIGS. 12 and 16) projecting from the inside of the cover 63, and have a common longitudinal axis 73 (FIG. 11) which is the pivot axis of the cover 63. The hinge pins 64 have free ends pointing toward one another, between which a free space is present, in which a crosspiece 74 (FIG. 12) of the hinge member is situated. The hinge member is provided with two resiliently flexible catches 75 (FIGS. 12 and 13) which enter into an associated recess 76 in the insulating body 11 and are secured against removal by retaining hooks 77.

Figure 12:
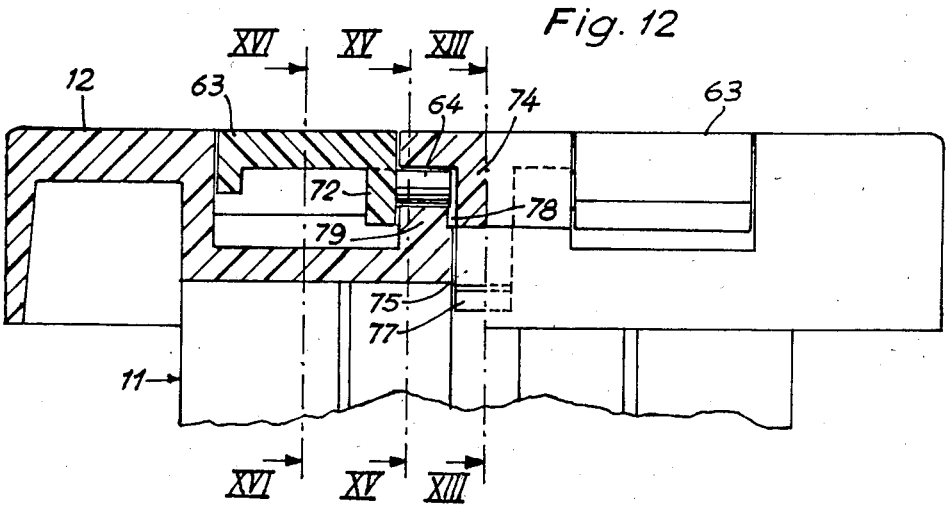
FIG. 12 is a fragmentary bottom view of the connector of FIG. 11, partially in a cross section taken along line XII—XII of FIG. 11.
Figure 13:
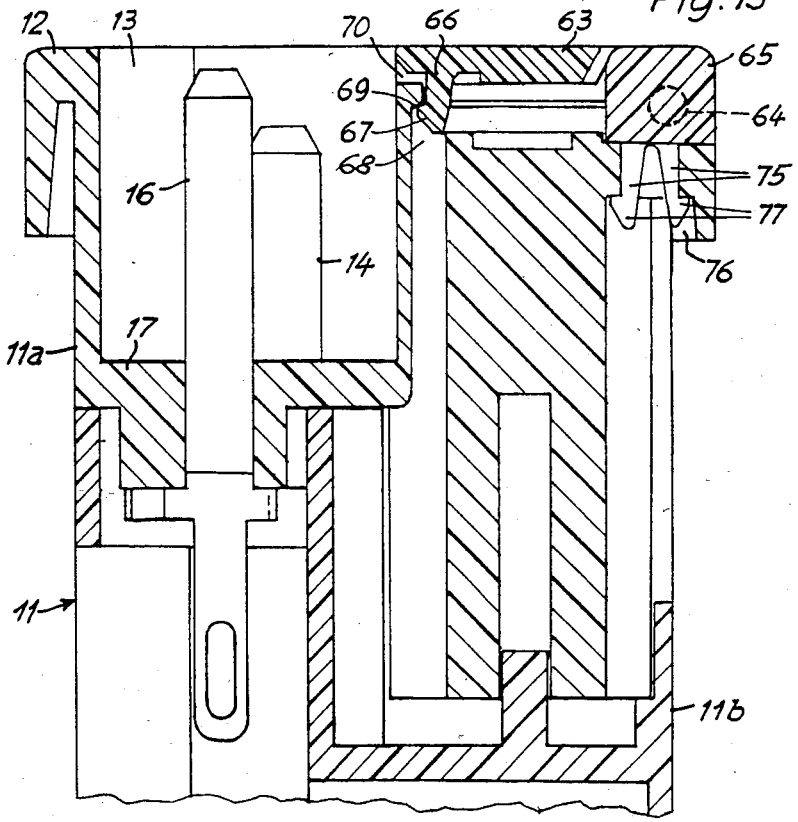
FIG. 13 is a longitudinal cross section taken along line XIII—XIII of FIG. 12.
Figure 14:
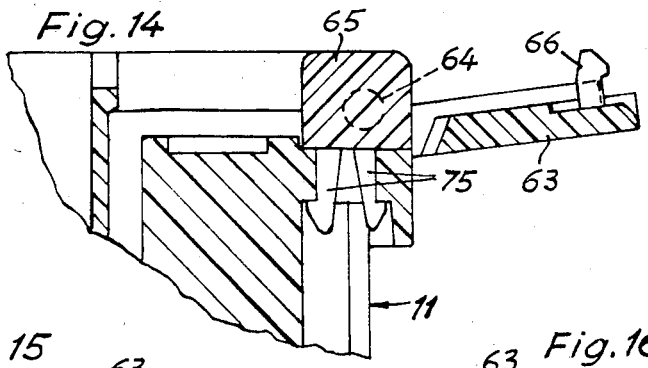
FIG. 14 is a fragmentary cross section corresponding to FIG. 13 with the cover open.
Figure 15:
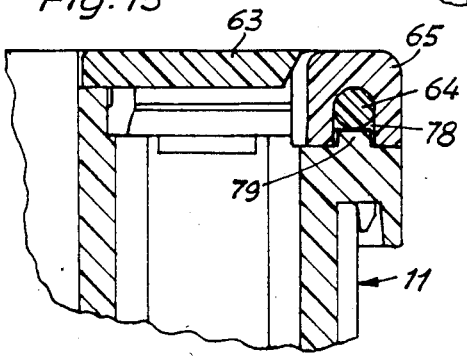
FIG. 15 is a fragmentary cross section taken along line XV—XV of FIG. 12.
Figure 16:
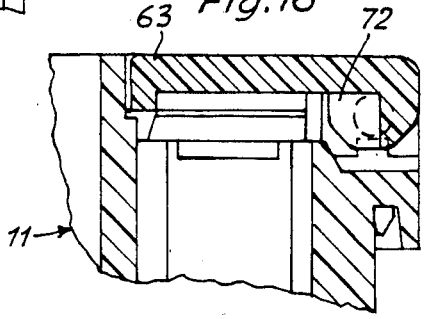
FIG. 16 is a similar fragmentary cross section taken along line XVI—XVI of FIG. 12.

As shown in FIGS. 12 and 15, the pivot sockets 78 accommodating the hinge pins 64 in the hinge member 65 open towards the insulating body 11, so that the hinge pins 64 can be inserted into the pivot sockets 78 transversely of their common longitudinal axis 73. Furthermore, two cam-like projections 79 are formed on the insulating body 11, each of which engages one of the pivot sockets 78 and supports the particular hinge pin 64. Thus the socket for each hinge pin 64 consists of two parts, namely the projection 79 formed integrally with the insulating body 11, and the portion of the hinge member 65 having the pivot socket 78, which is fastened by the resilient projections 75 on the insulating body 11.

By means of this design, a simple, effortless assembly of the insulating body 11 and cover 63 is made possible. The two hinge pins 64 of cover 63 are inserted transversely of their common longitudinal axis 73 into the pivot sockets 78 in the hinge member 65 as long as the latter is still separated from the insulating body 11. Then the two resilient projections 75 are inserted into the recess 76 of the insulating body until the hooks 77 on the projections 75 snap into place. The projections 79 on the insulating body 11 have then entered into the pivot sockets 78 of the hinge member 65, as best seen in FIGS. 12 and 15, thereby providing for each hinge pin 64 an adequate support in the particular pivot socket 78. The cover 63 can then be turned about the axis 73 and brought either into the open state shown in FIG. 14 or into the closed state shown in FIGS. 11 to 13, 15 and 16.

In case of necessity, the cover 63 can be removed from the insulating body by separating the hinge member 65 from the insulating body 11. This can be accomplished by pinching together the resilient projections and then lifting up the hinge member 65.

It can be seen that, in a variant embodiment, the cover 63 can have two hinge pins pointing away from one another, which then will require a separate hinge member similar to hinge member 65 for each. The embodiment described in reference to FIGS. 11 to 16, however, is simpler and thus more advantageous.

The embodiments of the invention in which an exclusive property or privilege is claimed are as follows:

1. In an electrical device including a system for the accommodation of at least one fuse cartridge of the type having an insulation tube with a pair of electrically conductive end caps and a fusible wire disposed in the insulating tube and interconnecting the end caps, the electrical device comprising an insulating body with at least one recess, a holder for the fuse cartridge releasably inserted into an active position within the recess of the insulating body, the holder having an insulating portion with an inner and an outer end and a clip disposed at the inner end of the insulating portion for removably holding one end cap of the fuse cartridge, a bottom contact member disposed within the recess of the insulating body for contacting the other end cap of the fuse cartridge, a compression spring biasing the holder relative to the insulating body in the direction of release from the insulating body, and at least one side contact member also disposed in the recess, said holder being further provided with at least one resiliently flexible slide contact member electrically connected to the clip of the holder and biased, by virtue of the resiliency thereof, against the side contact member in the recess of the insulating body when the holder is in the active position, whereby the insulating portion of the holder for the fuse cartridge is slidingly and non-rotatably guided in the recess of the insulating body such that the holder is slidingly insertable into the recess and removable therefrom in a rectilinear manner without rotation, the insulating portion of the holder having a lateral resiliently flexible tongue extending in the sliding direction of the holder toward and beyond the outer end of the insulating body of the holder, said tongue being provided with a locking hook and an externally graspable free end portion, the insulating body having a locking edge disposed so that, due to the resilience of said tongue, the locking hook thereof automatically enters into locking engagement with the locking edge when the holder is inserted into the active position in the recess of the insulating body to lock the holder in the active position against the bias of the compression spring, said tongue being flexible under a pressure manually exerted on the graspable free end portion against the influence of its own resilience for moving the locking hook out of engagement with the locking edge to permit movement of the holder in response to the bias of the compression spring and withdrawal of the holder out of the recess of the insulating body.

2. The electrical device according to claim 1, wherein the insulating portion of the holder includes a recess open at the inner end of the insulating portion and extending toward a supporting surface disposed at a distance from the outer end of the insulating portion, the clip and the slide contact member being assembled to form a structural unit which is mounted in the recess of the insulating portion of the holder for displacement in the sliding direction of the holder, said compression spring being located between the structural unit and the supporting surface of the insulating portion for biasing said other end cap and the fuse cartridge against the bottom contact member when the holder is in the active position in the recess of the insulating body, the insulating portion of the holder including a slot extending in the sliding direction of the holder, and the slide contact member projecting through the slot.

3. The electrical device according to claim 2, wherein the insulating portion of the holder includes an elongated lateral opening communicating with the recess of the insulation portion, said lateral opening extending in the sliding direction of the holder and having inner and outer ends, and the structural unit including a locking tongue which projects through the lateral opening and is arranged for abutting against the inner end of the lateral opening for preventing the structural unit from slipping out of the recess in the insulation portion when the holder is removed out of the recess of the insulating body, said locking tongue having an elongated free end portion extending substantially parallel to the sliding direction of the holder and outside of the insulating portion thereof.

4. The electrical device according to claim 1, wherein the insulating body has a second recess and a second holder slidingly guided therein for a second fuse cartridge, the two recesses and the two holders being of identical construction, shape and size, and the two recesses of the insulating body being arranged side-by-side and symmetrically with respect to an imaginary plane between the recesses so that in the active positions of the two holders in the recesses of the insulating body the respective tongues of the insulating portions of the two holders confront one another, and a portion of the insulating body is disposed between the two recesses and is provided with a pair of locking edges such that the locking hook on the tongue of the insulating portion of each holder independently can be brought into locking engagement with one or the other of the locking edges, respectively, when the holders are inserted into the active positions in the recesses of the insulating body.

5. The electrical device according to claim 1, wherein a cover is pivotally hinged on the insulating body for covering the outer end of the insulating portion of the holder when the latter is in the active position in the recess of the insulating body, the cover having at least one hinge pin made integral with the cover and the insulating body being provided with at least one bearing accommodating the hinge pin, the bearing comprising a first part made integral with the insulating body and a separate second part which is fastened to the insulating body by means of at least two resiliently flexible holding fingers engaging associated holes in the insulating body and each having a retaining hook which, by virtue of the resilience of the finger, is snapped into engagement with a locking edge of the associated hole for securing the finger against slipping out of the hole, the first and the second parts of the bearing being shaped such that the hinge pin can be moved transversely of the longitudinal axis thereof into engagement with the first and second parts as long as the second part is separated from the insulating body.

6. The electrical device according to claim 4, wherein a cover is pivotally hinged on the insulating body for covering the outer ends of the insulating portions of the two holders when the latter are in the active positions in the two recesses of the insulating body, the cover having at least one hinge pin made integral with the cover and the insulating body being provided with at least one bearing accommodating the hinge pin, the bearing comprising a first part made integral with the insulating body and a separate second part which is fastened on the insulating body by means of at least two resiliently flexible holding fingers engaging associated holes in the insulating body and each having a retaining hook which, by virtue of the resilience of the finger, is snapped into engagement with a locking edge of the associated hole for securing the finger against slipping out of the hole, the first and second parts of the bearing being shaped such that the hinge pin can be moved transversely of the longitudinal axis thereof into engagement with the first and second parts as long as the second part is separated from the insulating body.

* * * * *